US005711764A

United States Patent [19]

Wasinger

[11] Patent Number: 5,711,764

[45] Date of Patent: Jan. 27, 1998

[54] COMPOSITION AND PROCESS FOR DECOLORIZING AND/OR DESIZING GARMENTS

[76] Inventor: Eric M. Wasinger, 16403 Ledge Way, San Antonio, Tex. 78232

[21] Appl. No.: 725,630

[22] Filed: Oct. 3, 1996

[51] Int. Cl.[6] ..... D06L 3/02; B01D 19/00; C11D 1/37; C11D 3/395

[52] U.S. Cl. ..... 8/110; 8/101; 8/102; 8/109; 8/110; 8/127; 8/115.6; 510/276; 510/290; 510/289; 510/308; 510/317; 510/322; 510/329; 510/340; 510/352; 510/357; 510/492; 510/501; 510/504

[58] Field of Search ..... 8/101, 102, 109, 8/110, 127, 115.6; 510/276, 290, 289, 308, 317, 322, 329, 340, 352, 357, 492, 501, 504

[56] References Cited

U.S. PATENT DOCUMENTS

| | | | |
|---|---|---|---|
| 3,976,488 | 8/1976 | Nihyakumen et al. | 96/49 |
| 4,092,251 | 5/1978 | Smith | 252/8.1 |
| 4,294,576 | 10/1981 | Helfert et al. | 8/137.5 |
| 4,844,710 | 7/1989 | Guth et al. | 8/127.1 |
| 5,254,283 | 10/1993 | Arnold et al. | 252/174.12 |
| 5,512,062 | 4/1996 | Fuller et al. | 8/499 |
| 5,611,818 | 3/1997 | Domingo | 8/524 |
| 5,635,468 | 6/1997 | Ara et al. | 510/392 |

*Primary Examiner*—Douglas J. McGinty
*Assistant Examiner*—Charles Boyer
*Attorney, Agent, or Firm*—John Lezdey

[57] ABSTRACT

A composition is provided for improving decolorizing and desizing garments and fabrics with a reducing agent in a washer. A surfactant is added so as to improve wet out and to reduce the surface tension of the water.

3 Claims, No Drawings

COMPOSITION AND PROCESS FOR DECOLORIZING AND/OR DESIZING GARMENTS

FIELD OF THE INVENTION

The present invention relates to improved compositions and processes for desizing and/or decolorizing garments and fabrics utilizing reducing agents. More particularly, there is provided novel compositions which contain reducing agents and surfactants which more effectively desize and/or decolorize fabrics and garments at lower costs.

BACKGROUND OF THE INVENTION

Garment and fabric processing today includes dyeing, abraiding, decolorizing, softening and desizing. Sizing is important in the fabric weaving process. The size is usually removed in a finishing operation after the fabric is woven. In some fabrics e.g., denim, the size is left in to give desirable properties to the denim garment so as to improve the wear properties of the fabrics or garments. However, if the garments or fabrics are further processed, for example, treated with a crosslinking agent and/or decolorized or finished in garment form, it is necessary to first remove the sizing.

Reducing agents are employed in the textile industry for the solubilization of vat and sulfur dyes, as an antichlor in the chlorine bleaching or color removal of textiles, to desize fabrics and the like. The reducing potentials of the reagents employed differ depending upon the job that the reducing compound is required to perform. For example, in the solubilization of vat dyes, the more powerful alkaline sodium hydrosulfite (caustic and hydro) is employed to convert the vat dyes to the leuco form. In the case of the sulfur dyes, this can be accomplished with sodium sulfide ($Na_2S$). Further, for the removal of the chlorine in chlorine oxidants after the bleaching steps, sodium thiosulfate ($Na_2S_2O_3$) or sodium bisulphite ($NaHSO_3$) is employed.

It is known that reducing agents such as sodium hydrosulfite, thiourea, thiourea dioxide, sodium sulfoxylate formaldehyde among others could be employed to simultaneously desize and remove indigo dyes from denim fabrics. It has now been found that when this process is accomplished by the additions of surface active agents the process is considerably faster than if the surfactants are not employed. The results in the reduction of vat dyes, particularly indigo, during the fade down process to produce a "stone washed" or "acid washed" look, that the reduction speed not only depends upon the particular dye and its reducibility (i.e., its thermodynamic, coloristic and kinetic properties) but the condition of the fabric in the wash cycle, and to a large extent upon the behavior of the dye in the application medium.

The type of surfactant employed will, to a large extent, depend upon the pH of the process employing the reducing agents. For example, in alkaline mediums, either a anionic or nonionic surfactant will be employed while in acidic mediums a cationic or nonionic surfactant will be employed. If the reaction shifts from acid to basic or visa versa, during the course of the reaction, an amphoteric surfactant can also be employed.

The role of the surfactant is probably several fold. It would be the sum of these roles that result in the surprising increase in the effectiveness of the processes when they are employed. One affect that certainly occurs is to reduce the surface tension of the water so that better and more rapid wet out of the fabric surface and improved penetration of the water solutions and compounds within the yarn or starch structure can occur. Another factor is that the surfactant can reduce the negative surface charge of the fiber especially when anionic surfactants are employed. The surfactant cation in anionic type surfactants is usually a monovalent element such as sodium and potassium. These ions can become mobile (ionize) and associate with the fiber, size or dye surfaces forming Stern double layers that apparently reduce the barriers to the approach of the reducing agents toward the reaction sites.

For example, reducing agents react with vat dyes such as indigo under alkaline conditions to solubilize them in their leuco form. The organic hydrophobic tails of the surfactant molecule can react with the insoluble "oxidized" form of the organic dye through Van der Waal associations. Thusly, the hydrophobicity of the dye is reduced and the more polar "surfactant-dye" complex can be more easily approached by the reducing agent and reaction will be more likely to occur. That is, the surfactant-dye complex has better solubility in the aqueous phase than does the dyestuff alone. This is particularly important when the dye molecule may be locked within the fiber substrate where the negatively charged surface barriers must first be eliminated or circumvented. Finally, the increase in the level of surfactant will increase the zeta potential and thusly increase the repulsion forces between the dye molecules as well as other particles that may be reducible.

SUMMARY OF THE INVENTION

The present invention provides compositions for decolorizing fabrics and garments, which compositions contain a surfactant and a reducing agent. Optionally, there can be included soil or dye redepositing prevention agents and fillers. Preferably, the compositions contain from about 40 to 60% by weight of a reducing agent and about 5 to 20% by weight of a surfactant. However, merely providing 40–60% by weight of a reducing agent and 60–40% by weight of a surfactant has been effective to provide suitable desizing and discolorization of garments.

Depending upon the reducing agent utilized, there may be included pH adjusters.

Preferably, the compositions are used in a liquor ratio of about 10:1 and 30:1. Liquor ratios below 10:1 have been found to cause streaking and to provide uneven finishes.

The object of the present invention is to provide more effective compositions containing reducing agents for the decolorization and/or desizing of fabrics and garments.

Another object of the invention is to provide a reducing composition which decolorizes garments without any substantial degradation of the fabric.

A further object of the invention is to maximize the effect of a reducing agent in a process for decolorizing dyed fabrics.

Still another object of the invention is to provide a composition which desizes and softens processed fabrics.

DESCRIPTION OF THE PREFERRED EMBODIMENTS

Although Specific terms are used in the following description for the sake of clarity, these terms are intended to refer only to the particular feature of the invention selected for illustration and are not intended to define or limit the scope of the invention.

According to one embodiment of the present agent there is provided a composition for use in decolorizing dyed fabrics and garments which comprises about 40 to 60% by weight of a reducing agent and about 5 to 20% by weight of a surfactant.

The compositions of the present invention may optionally contain other known adjunct substances in addition to the above-mentioned critical components. For example, there may be used builders such as water-soluble inorganic builders, for example, sulfates, carbonates, bicarbonates, silicates, phosphates and organic builders, for example, ethylene-diamine tetraacetate, tartrates and citrates. PH regulators and buffers may be utilized depending upon the reducing agent and the pH of the bath required. Sodium and/or potassium hydroxide are preferred for the reducing agents which are active under basic conditions. Anti-foaming agents and soil or dye redeposit agents can also be used.

According to another embodiment of the present invention, sized and/or dyed fabrics and garments which are required to be desized before undergoing further processing can be treated with the compositions of the present invention which contain a reducing agent and surfactant so as to remove the sizing. If desired, such as in the case of denim jeans, where the present fashion requirement is a bleached or washed appearance, the garment can be simultaneously desized and decolorized. Typically, blue jeans which would normally undergo only desizing in a washer-extractor, can now undergo simultaneous desizing and decolorization by treatment with the compositions of the present invention.

The denim jeans are normally placed in a drum type washer-extractor and covered with water at an elevated temperature, preferably at a temperature range between about 120° to 200° F. A composition of the invention which contains a reducing agent along with a surfactant is added and the mixture is agitated for a period of about 20 minutes, depending upon the reducing agent and type of sizing utilized.

Advantageously, a dye complexing agent such as carboxymethycellulose, polyvinyl pyrrolidone or the like is added to prevent redeposit of the degradated dye.

Typical reducing agents which are useful for desizing starch type sizing and decolorizing denim jeans include alkali metal, hydrosulfites, hydrogen sulfites, sulfides, thiosulfates, oxalates, alkali metal sulfoxylate formaldehyde, for example $NaHSO_2CH_22H_2O$, thiourea dioxide, and the like.

The compounds which are especially useful for reducing sulfur dyes include sodium hydrosulfite, sodium hydrosulfide and sodium sulfide. Reducing sugars such as glucose and dextrose may be added to the compositions.

Other suitable reducing agents include arsenious oxide and titaneous sulfate, which is useful for reducing reactive dyes.

Advantageously, sodium or zinc sulfoxylate formaldehyde is used under either acidic or basic conditions and sodium hydrosulfite is used under basic conditions.

The surfactants which can be used in the present compositions are the water soluble anionic, nonionic, ampholytic, zwitterionic or cationic surfactants.

Suitable anionic surface active agents include, for example, alkali metal salts of alkyl substituted benzene sulphonic acids, alkali metals salts of long chain fatty sulphates, alkali metal ether sulphates derived from alcohols and alkyl phenols, alkali metal sulpho-succinates, alkali metal sarcosinates and alkali metal taurides. Suitable cationic surface active agents include quaternary ammonium bromides and chlorides containing a long chain alkyl group such as, for example, Cetrimide or benzalkonium chloride. Suitable amphoteric surface active agents include so called "betaine" type and imidazoline type surface active agents.

Preferred anionic surfactants include alkyl dimethylamine oxides having 12 to 25 carbon atoms such as N,N-dimethyl-1-tetradecanamine oxide and N,N-dimethyl-1-octadecananime oxide, sodium lauroyl sarcosinate, diphenyl ether sulfonates such as the alkali metals salts of hexadecyl diphenyl ether disulfonic acid, dodecyl diphenyl ether disulfonic and decyl diphenyl ether disulfonic acid, preferably $C_{10}$–$C_{18}$ alkylbenzene sulfonates. Commercially available anionic surfactants which may be used include Ufaryl DL80, DL85 and DL90 of Unger Fabrikker which are mixtures of $C_{10}$–$C_{13}$ linear sodium alkylbenzene sulfonate, Udet 950 of De Soto, Nacconol 90G of Stepan Corporation (a $C_{11.7}$ linear alkybenzene sulfonate), Calsoft F90 of Pilot Corporation (a $C_{10}$–$C_{13}$ sodium linear alkylaryl sulfonate). Witconate 90F of Witco Corporation (a $C_{12}$ sodium alkylaryl sulfonate containing 1.7% free oil and 3.0% $SO_4$), Nansa HS 80PF of Albright & Wilson Ltd. and Stepan agent S-1509-65 of Stepan Corporation (a $C_{13}$ calcium dodecylbenzene sulfonate).

Nonionic surfactants which can be used in practicing the present invention can be of three basic types—the alkylene oxide condensates, the amides and the semi-polar nonionics.

The alkylene oxide condensates are broadly defined as compounds produced by the condensation of alkylene oxide groups (hydrophilic in nature) with an organic hydrophobic compound, which can be aliphatic or alkyl aromatic in nature. The length of the hydrophilic or polyoxyaklylene radical which is condensed with any particular hydrophobic group can be readily adjusted to yield a water soluble compound having the desired degree of balance between hydrophilic and hydrophobic elements.

Examples of such alkylene oxide condensates include:

1. The condensation products of aliphatic alcohols with ethylene oxide. The alkyl chain of the aliphatic alcohol can either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above described coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by The Proctor & Gamble Company.

2. The condensation products of ethylene oxide with a hydrophobic base formed by the condensation of propylene oxide with propylene glycol. The hydrophobic portion of these compounds has a molecular weight of from about 1500 to 1800 and of course exhibits water insolubility. The addition of polyoxyethlene moieties of this hydrophobic portion tends to increase the water solubility of the molecule. Examples of compounds of this type include certain of the commercially available Pluronic surfactants marketed by the Wyandotte Chemicals Corporation.

3. The condensation products of ethylene oxide with the product resulting from the reaction of propylene oxide and ethylene diamine. The hydrophobic base of these products consists of the reaction product of ethylene diamine and excess propylene oxide, said based having a molecular weight of from about 2500 to about 3000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

Examples of the amide type of nonionic surfactants include the ammonia, monoethanol and diethanol amides of fatty acids having an acyl moiety of from about 8 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by hydrogenation of carbon monoxide by the Fischer-Tropsch process.

Examples of the semi-polar type of nonionic surfactants are the amine oxides, phosphine oxides and sulfoxides. These materials are described more fully in U.S. Pat. No. 3,819,528, Berry, issued Jun. 25, 1974, and incorporated hereinby reference.

Ampholytic surfactants which can be used in practicing the present invention can be broadly described as derivatives of aliphatic amines which contain a long chain of about 8 to about 18 carbon atoms and an anionic water-solubilizing group, e.g., carboxy, sulfo and sulfato. Examples of compounds falling within this definition are sodium 3-dodecylamino-propionate, sodium-3-dodecylamino propane sulfonate, and dodecyl dimethylammonium hexanoate.

Zwitterionic surfactants which can be used in practicing the present invention are broadly described as internally-neutralized derivatives of aliphatic quaternary ammonium and phosphonium and tertiary sulfonium compounds, in which the aliphatic radical can be straight chain or branched, and wherein one of the aliphatic substituents contains from about 8 to about 18 carbon atoms and one contains an anionic water solubilitizing group, e.g., carboxy, sulfo, sulfato, phosphato, or phosphono.

Cationic surfactants which can be used in practicing the present invention include stearyl dimethyl benzyl ammonium chloride, coconut dimethyl benzyl ammonium chloride, cetyl pyridinium chloride, and cetyl trimethyl ammonium chloride.

Particularly preferred surfactants for use herein are sodium and potassium alkyl naphthalene sulfonates having one or two alkyl groups containing from 1 to about 6 carbons each, and paraffin sulfonates having the formula $RSO_3M$, wherein R is a primary or secondary alkyl group containing from about 8 to about 22 carbon atoms (preferably about 12 carbon atoms), and M is an alkali metal.

Preferred compositions of the invention contain:

about 40 to 60% by weight of a reducing agent;

about 5 to 20% by weight of a surfactant;

about 1 to 6% by weight of an anti-foaming agent;

about 5 to 15% by weight of a soil or dye redeposit prevention agent; and about 20 to 40% by weight of fillers.

Preferred fillers include calcium sulfate, stabilizers and buffers.

The garments or fabrics to which the present may be applied comprise both natural and/or synthetic fibers including cotton, linen, other bast fibers, rayon, wool, polyester, rayon, alone or in combination with other natural or synthetic fibers.

Preferably, the garment or fabric is desized and/or decolorized without causing degradation of the fabric.

The type of dye used on the garment is not critical. It is only important that the dye is reactive with the reducing agent where intended. Cellulose substantive dyes, such as vat dyes, which are common in the garment industry, are preferably used. Exemplary of the dyes which are or can be made to be substantive to cellulose that can be used include Acid Light Scarlet GL, and acid leveling dye, Sevron Brilliant Red 2B, indigo vat dye, a cationic dye, Sulfonine Brilliant Red B, and anionic dye, Brilliant Milling Red B, C.I. Disperse Blue, pyrazolone azomethine dye, hydroxy azo dyes, or the like. Other suitable dyes that can be used are identified in the paper of Charles B. Sweeney entitled, "Identifying a Dye can be Simple or it can Involve Hours of Laboratory Analysis", Textile Chemist and Colorist, Vol. 12, No. 1, January 1980, pp 26/11, which is incorporated herein by reference.

In a preferred operation of the process of the invention, the garments or fabrics are placed in a washer-extractor which is similar to the type that would have been utilized in a conventional desizing operation utilizing an enzyme. The washer-extractor is then filled with water having an elevated temperature, that is, about 120° to 185° F. The higher the temperature the greater the discoloration. It is understood that at the higher temperatures the compositions of the invention contains a reducing agent having a requisite temperature stability. The bath is normally agitated for about 0.3 to 1.0 hour and then the water is extracted and the garments or fabrics are rinsed with water. The garments or fabrics can then be further processed if desired.

The amount of composition utilized is determined by the type of reducing agent utilized and the effect desired. For example, in a commercial size washer-extractor in which about 180 denim jeans are to be desized, when thiourea dioxide is the reducing agent, about 2.0 lbs is used in a bath containing 260 gal. of water to achieve a light blue effect. While about 3.0 lbs gives a pale blue effect. It is understood that compounds such as polyvinylpyrrolidone can be added to the system to prevent redeposition of the dye removed from the garments during reduction.

The following examples are illustrative of the practice of the method of the present invention. It will be understood, however, that is not to be construed in any way limitative of the full scope of the invention since various changes can be made without departing from the spirit of the teachings contained herein in light of the guiding principles which have been set forth above. All percentages stated herein are based on weight except wherein otherwise noted.

EXAMPLE 1

A composition of the invention was prepared by admixing the following:

| Ingredient | Wt % |
|---|---|
| Thiourea dioxide | 35 |
| Napththalene sulfonate surfactant | 35 |
| Polyvinyl pyrrolidone | 10 |
| Calcium phosphate | 10 |
| Calcium sulphate | 10 |
| | 100 |

The composition may include defoaming agents, stabilizers maintain good shelf life and moisture absorbing agents.

EXAMPLE 2

A composition of the invention was prepared by admixing the following ingredients:

| Ingredient | Wt % |
|---|---|
| Sodium sulfoxylate formaldehyde | 50 |
| Dodecyltrimethyl ammonium chloride | 10 |
| Acetic acid | 5 |
| Sodium acetate | 10 |
| Polyvinyl pyrrolidone | 5 |
| Ufaryl DL 80 | 20 |
| | 100 |

EXAMPLE 3

Into a 550 lb. capacity rotary drum washer-extractor was placed 180 blue dyed denim jeans containing a starch sizing and weighing about 396 lbs. About 495 gal. of water (liquor ratio 10:1) at a temperature of 190° F. is added to the washer-extractor. The drum is rotated to wet out the garments and 6.0 lbs of the composition of Example 1 along with caustic to raise the pH to between 11 and 12. The drum was rotated for about 20 minutes and the water was extracted. The garments were then rinsed twice with 220 gal. of cold water and spun to extract the water and dried. There was good clean-up of the apparatus after the treatment with the reducing agents.

The resulting garments were all desized and decolorized to a very light blue. If an even lighter color is desired the process can be repeated for 10 minutes prior to rinsing since concurrent desizing is not necessary.

EXAMPLE 4

The procedure of Example 3 was followed except that in lieu of the composition of Example 1 and the sodium hydroxide there was utilized 3.0 lbs of the composition of Example 2 with sufficient citric acid to give a pH of 4.0–4.5 (buffered with sodium citrate) or acetic acid (56%) buffered with sodium acetate at a temperature of 180°–185° F.

The resulting garments were all desized and decolorized to a pale blue.

EXAMPLE 5

Denim fabric was reduced with sodium sulfoxylate formaldehyde at a pH of 5.0. Two cationic surfactants were employed along with a nonionic surfactant and a control employing no surfactant. The cationic surfactants were dodecyltrimethyl ammonium chloride (Dehyquart LT, 34–36% active ingredients from Henkel) and distearyltrimethyl ammonium chloride (Dehyquart DAM, active ingredients 70–80 from Henkel). The nonionic was an ethyoxylated alcohol (Triton X100, Rohm and Haas).

In all cases, the surfactant improved the efficiency of the dye removal as measured by spectrophotometric methods. The shorter chain cationic surfactants were significantly better than the longer chain molecule. The nonionic surfactant worked but not as well as either of the cationic surfactants. The results for a single extraction at 75° C. employing 7% reducing agent and 1.5% surfactant on the weight of the fabric (owf) at a liquor ratio of 40/1 for 15 minutes is illustrated in Table 1.

Table 1. Indigo Removal Efficiencies of Reducing Agents With And Without Cationic Surfactants

| Sample Designation | Percent Removal Compared to the Original Fabric |
|---|---|
| Control | 12 |
| Dodecil | 41 |
| Stearyl | 34 |
| Nonionic | 25 |

EXAMPLE 6

Denim fabric was reduced with alkaline sodium hydrosulfite at a pH of 11.5. Two anionic wetting agents were employed along with the nonionic wetting agent employed in Example 1! and a control extraction using no wetting agent. The wetting agents were dioctylsulfosuccinate [DOSS] (Amwet Doss 70, 40% active ingredients from American Emulsions) and sodium dodecylsulfate [DOS] (Fisher Scientific, approx. 98–99% active ingredients). The DOSS gave superior results to the DOS but both performed considerably better in their color removal efficiencies compared to the control sample as accessed by spectrophotometric methods. The anionic surfactant performed at a slightly lower efficiency than either the DOSS or DOS but still at a greater level of dye removal that did the control sample containing no surfactant. The results from a single extraction employing 7% reducing agent and 1.5% surfactant owf at a liquor ratio of 40/1 and at 75° C. for 15 minutes is shown in Table 1.

Table 2. Indigo Removal Efficiencies of Reducing Agents With and Without Anionic Surfactants

| Sample Designation | Percent Removal Compared to the Original Fabric |
|---|---|
| Control | 15 |
| DOSS | 35 |
| DOS | 30 |
| Nonionic | 24 |

What is claimed is:

1. A composition for use in desizing and decolorizing a fabric or garment in a washer with water which comprises:
   - about 40 to 60% by weight of a reducing agent selected from the group consisting of thiourea, thiourea dioxide, and alkali metal sulfoxylate formaldehyde;
   - about 5 to 20% by weight of an anionic surfactant;
   - about 1 to 6% by weight of an anti-foaming agent;
   - about 5 to 15% by weight of a dye or soil redeposit prevention agent; and
   - about 20 to 40% by weight of fillers.

2. The composition of claim 1 wherein said fillers comprise buffers and stabilizers.

3. A process for desizing and decolorizing fabrics or garments in a washer which includes placing into said washer a composition according to claim 1 in water in a liquor ratio of about 10:1 to 30:1 at an elevated temperature.

* * * * *